US007729648B2

(12) United States Patent
Sano et al.

(10) Patent No.: US 7,729,648 B2
(45) Date of Patent: Jun. 1, 2010

(54) DEVELOPING ROLLER HAVING SPECIFIC SURFACE LAYER, DEVELOPING DEVICE PROVIDED WITH THE DEVELOPING ROLLER AND IMAGE-FORMING APPARATUS PROVIDED WITH DEVELOPING DEVICE EQUIPPED WITH THE DEVELOPING ROLLER

(75) Inventors: Tetsuo Sano, Toyokawa (JP); Yohei Nakade, Okazaki (JP); Ichiro Demizu, Toyonaka (JP); Junpei Shouno, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 47 days.

(21) Appl. No.: 11/822,393

(22) Filed: Jul. 5, 2007

(65) Prior Publication Data

US 2008/0226357 A1 Sep. 18, 2008

(30) Foreign Application Priority Data

Mar. 12, 2007 (JP) ..... 2007-061273

(51) Int. Cl.
*G03G 15/08* (2006.01)

(52) U.S. Cl. ..... 399/286; 399/279

(58) Field of Classification Search ..... 399/286, 399/279, 265; 492/18, 48, 49, 53
See application file for complete search history.

(56) References Cited

U.S. PATENT DOCUMENTS 5,981,129 A * 11/1999 Akazawa et al. ..... 430/110.2
7,224,927 B2 * 5/2007 Sano et al. ..... 399/286

FOREIGN PATENT DOCUMENTS

| | | | |
|---|---|---|---|
| JP | 05-072889 A | | 3/1993 |
| JP | 06-324514 A | * | 11/1994 |
| JP | 08-076586 A | * | 3/1996 |
| JP | 8-160738 A | | 6/1996 |
| JP | 10-90994 A | | 4/1998 |
| JP | 2003-005504 A | | 1/2003 |
| JP | 2006-58847 A | | 3/2006 |

OTHER PUBLICATIONS

Machine translation of JP 06-324514 A dated Feb. 3, 2009.*
Machine translation of JP 08-076586 A dated Feb. 3, 2009.*
Machine translation of JP 10-090994 A dated Feb. 3, 2009.*
Notification of Reasons for Refusal in corresponding Japanese Patent Application No. 2007-061273 with English Translation.

* cited by examiner

*Primary Examiner*—Sophia S Chen
(74) *Attorney, Agent, or Firm*—Buchanan Ingersoll & Rooney PC

(57) ABSTRACT

A developing roller has a surface layer composed of a binder resin having an SP value in the range of 7.5 to 9.0, and roughness-imparting particles made from a resin having an SP value that has a difference from the SP value of the resin of 2 or less in the absolute value thereof. The roughness-imparting particles are dispersed in the binder resin. A developing device is provided with the developing roller. An image-forming apparatus is provided with the developing device equipped with the developing roller.

19 Claims, 3 Drawing Sheets

5a

DEVELOPING ROLLER HAVING SPECIFIC SURFACE LAYER, DEVELOPING DEVICE PROVIDED WITH THE DEVELOPING ROLLER AND IMAGE-FORMING APPARATUS PROVIDED WITH DEVELOPING DEVICE EQUIPPED WITH THE DEVELOPING ROLLER

This application is based on application(s) No. 2007-061273 filed in Japan, the contents of which are hereby incorporated by reference.

BACKGROUND OF THE INVENTION

1. Field of the Invention

The present invention relates to a developing roller, a developing device and an image-forming apparatus.

2. Description of the Related Art

Conventionally, in an electrophotographic printer, the surface of a photosensitive drum is evenly charged by a charging roller. Next, an electrostatic latent image is formed on the surface of the photosensitive drum by an exposing device, and toner is adhered to the electrostatic latent image by a developing device, so that the electrostatic latent image is visualized to form a toner image. Moreover, the toner image is transferred onto a medium by a transferring roller, and fixed thereon by a fixing device.

In the developing device, a mono-component developer containing only the toner is preferably used from the viewpoint of miniaturization of the device. In the developing device of this kind, a developing roller, which transports the toner to a developing area, is made in contact with, or brought close to the photosensitive drum so as to freely rotate thereon. Here, a supply roller that supplies the toner to the developing roller is made in contact with the developing roller so as to freely rotate thereon. Moreover, a blade that regulates the toner on the developing roller is placed with its tip being made in contact with the surface of the developing roller. In the developing device having this structure, the toner, housed in a toner cartridge, is supplied onto the developing roller by the supply roller, and the toner thus supplied is formed into a thin-film state by the blade in accordance with the rotation of the developing roller, and charged with a predetermined polarity to form a toner layer. The toner of the toner layer is transported to a developing portion between the developing roller and the photosensitive drum, and is electrostatically adhered onto the electrostatic latent image on the photosensitive drum, so that the electrostatic latent image is visualized to form a toner image.

With respect to the developing roller, in general, those having a resin layer on the surface are used, and organic or inorganic fine particles are dispersed in the resin layer so as to improve the toner transporting property.

For example, a developing sleeve, which has a coat layer on its surface, and has conductive inorganic fine particles contained in the coat layer, with fine concave and convex portions being formed on its surface, has been reported (Japanese Patent Application Laid-Open No. 8-160738). However, in the case when such a developing sleeve is used for a long time, the convex portions on the surface, formed by the conductive inorganic fine particles, are worn to cause the problem that the particles relatively easily come off from the surface. The separation of the particles causes a failure to provide sufficient toner charging property and transporting property. Moreover, the charging stability against environmental variations is lowered. In the case when the charging stability against environmental variations is lowered, since the change in the quantity of charge in the toner becomes extremely high due to variations in the ambient environment, the developing property is lowered, failing to provide sufficient image density to cause fogging and image irregularities. Therefore, a mechanism, such as a system to be used for measuring the ambient environmental factors (temperature, humidity and the like) so as to stabilize the developing property, is required, resulting in the problems of bulky devices and high costs due to an increase in the number of parts.

Here, for example, a developer-supporting member having a coat layer on its surface, with concave/convex portion-imparting particles indefinite in shape being contained in the coat layer, has been reported. However, such a developer-supporting member results in the problem that the particles are aggregated on the surface thereof. When the particles are aggregated, concave/convex irregularities occur on the surface to cause unevenness in the image density. Moreover, the problem of insufficient charging stability against environmental variations is also caused.

BRIEF SUMMARY OF THE INVENTION

The objective of the present invention is to provide a developing roller that can restrain aggregation and separation of particles contained in the surface layer and is superior in charging stability against environmental variations, a developing device provided with the developing roller and an image-forming apparatus provided with such a developing device.

The present invention relates to a developing roller, having a surface layer composed of;

a binder resin having a solubility parameter (SP) value in the range of 7.5 to 9.0; and roughness-imparting particles made from a resin having an SP value that has a difference from the SP value of said resin of 2 or less in the absolute value thereof, the roughness-imparting particles being dispersed in the binder resin, and also concerns a developing device having such a developing roller and an image-forming apparatus having such a developing device.

DETAILED DESCRIPTION OF THE INVENTION

The present invention relates to a developing roller, having a surface layer composed of;

a binder resin having an SP value in the range of 7.5 to 9.0; and roughness-imparting particles made from a resin having an SP value that has a difference from the SP value of said resin of 2 or less in the absolute value thereof, the roughness-imparting particles being-dispersed in the binder resin, and also concerns a developing device having such a developing roller and an image-forming apparatus having such a developing device.

The developing roller, developing device and image-forming apparatus of the present invention make it possible to restrain aggregation and separation of roughness-imparting particles contained in the surface layer of the developing roller. Therefore, it becomes possible to achieve even image density, and also to stably achieve sufficient charging property and transporting property with respect to the toner. The charging stability against ambient environmental variations can be improved as well.

Figure 1:
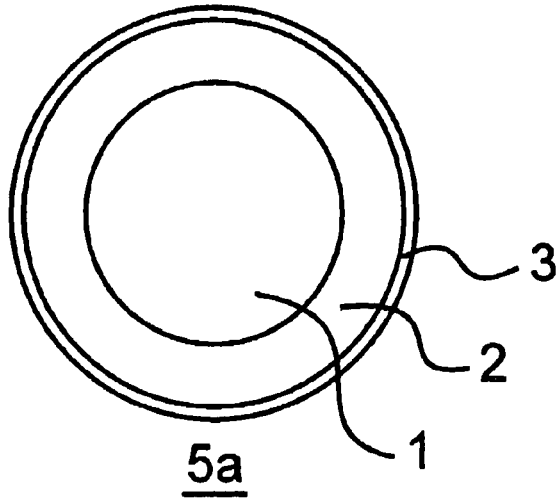
FIG. 1(A); schematic drawing that shows one example of a cross section perpendicular to the axial direction of a developing roller in accordance with the present invention.
FIG. 1(B); an enlarged view of the vicinity of the surface of FIG. 1(A).
Figure 1:
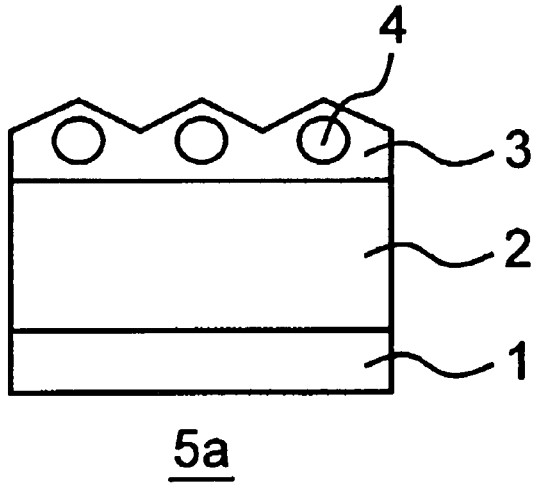
Figure 2:
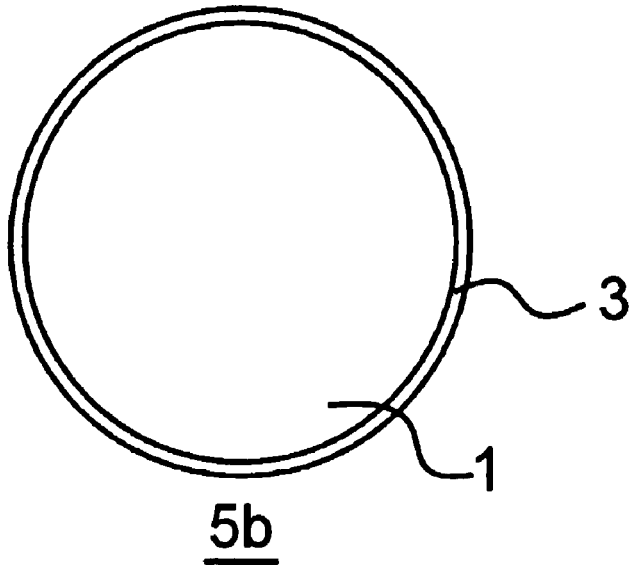
FIG. 2(A); a schematic drawing that shows another example of a cross section perpendicular to the axial direction of a developing roller of the present invention.
FIG. 2(B); an enlarged view of the vicinity of the surface of FIG. 2(A).
Figure 2:
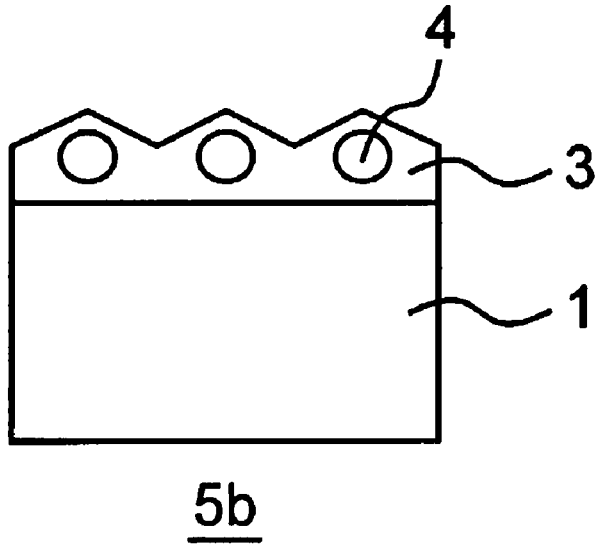

The developing roller of the present invention is provided with a specific surface layer formed on its outermost surface. The structure of the developing roller is not particularly limited, as long as the specific surface layer is formed on its outermost surface, and it may have a structure of a developing roller 5*a* in which, as shown in FIGS. 1(A) and 1(B), an elastic layer 2 and a surface layer 3 are successively laminated on a base member 1, or a structure of a developing roller 5*b* in which, as shown in FIGS. 2(A) and 2(B), a surface layer 3 is directly laminated on a base member 1. In each of the developing rollers 5*a* and 5*b*, a primer layer (not shown) may be formed right beneath the surface layer 3 in order to improve the adhesive property of the surface layer. In FIGS. 1 and 2, (A) is a schematic drawing that shows one example of a cross section perpendicular to the axial direction of the developing roller, and (B) is an enlarged view showing the vicinity of the surface of (A).

The base member 1 is not particularly limited as long as it can support layers to be formed thereon and exerts superior conductivity. Normally, it is prepared as a cylinder-shaped core metal member made of aluminum, non-magnetic stainless steel or the like. The surface thereof may be plated.

The elastic layer 2 is generally made of a known rubber material, and may contain a conductive agent on demand. With respect to the rubber material, for example, silicone rubber, acrylonitrile-butadiene rubber, ethylene propylene rubber, polyurethane rubber or the like may be used. Preferably, silicone rubber is used because this makes it possible to design the compression set of the elastic layer to a low level. With respect of the rubber material, one kind thereof may be used, or two or more kinds thereof may be used in combination.

With respect to the conductive agent, for example, an electron conductive agent and an ion conductive agent are listed.

Specific examples of the electron conductive agent include: conductive carbon, such as Ketchen black, Acetylene Black, Furnace Black, Lamp Black, Thermal Black and Channel Black; carbon for rubber, such as SAF, ISAF, HAF, FEF, GPF, SRF, FT and MT; carbon for ink that has been oxidized; thermally decomposed carbon and graphite; conductive metal oxides such as tin oxide, titanium oxide and zinc oxide; and metals such as nickel and copper. With respect of the conductive agent, one kind thereof may be used, or two or more kinds thereof may be used in combination.

Specific examples of the ion conductive agent include: ammonium salts composed of plus ions derived from tetraethyl ammonium, tetrabutyl ammonium, lauryltrimethyl ammonium (dodecyltrimethyl ammonium), stearyltrimethyl ammonium (octadecyltrimethyl ammonium), hexadecyltrimethyl ammonium, benzyltrimethyl ammonium, modified fatty acid dimethylethyl ammonium, or the like, and minus ions derived from perchloric acid salt, chloric acid salt, hydrochloric acid salt, bromic acid salt, iodic acid salt, borohydrofluoric acid salt, sulfuric acid salt, ethyl sulfuric acid salt, carboxylic acid salt, sulfonic acid salt, or the like; and perchloric acid salt, chloric acid salt, hydrochloric acid salt, bromic acid salt, iodic acid salt, borohydrofluoric acid salt, trifluoromethyl sulfuric acid salt, sulfonic acid salt, or the like, of alkali metal or alkaline earth metal, such as lithium, sodium, calcium and magnesium.

For example, in the case of the ion conductive agent, although not particularly limited, the compounding ratio of the conductive agent is preferably set in the range from 0.01 to 5 parts by weight, in particular, from 0.05 to 2 parts by weight, with respect to 100 parts by weight of rubber material. In the case of the electron conductive agent, it is preferably set in the range from 1 to 50 parts by weight, in particular, from 5 to 40 parts by weight, with respect to 100 parts by weight of rubber material.

The volume resistivity of the elastic layer is preferably set in the range from $10^3$ to $10^{10}$ Ω·cm, in particular, from $10^4$ to $10^6$ Ω·cm.

In the present specification, the volume resistivity is indicated by a value measured in compliance with JIS standard (K6911). The value is obtained through measurements under measuring conditions of 20 to 25° C. and 50 to 60 RH %, by using a voltage-drop-type digital Ohm meter (made by Kawaguchi Electric Works Co., Ltd.) for measuring volume resistivity of conductive rubber and plastics.

In addition to the conductive agent, various additives, such as a filler, a crosslinking agent and another additive for rubber, may be appropriately added to the elastic layer, if necessary.

The elastic layer can be molded on a conductive core metal of a base member by using a method such as an extrusion-molding method, an injection-molding method and a casting method. After the molding process, the elastic layer is cured by applying heat to impart elasticity. After forming the elastic layer, the surface is preferably polished by using various polishing methods so as to improve dimensional precision (with respect to outer diameter, sway, etc.) and evenness of the surface (surface roughness).

Although not particularly limited, the average thickness of the elastic layer is preferably set, for example, in the range from 0.3 to 3.0 mm, in particular, from 0.5 to 2.0 mm.

The surface layer 3 is formed by adding specific roughness-imparting particles 4 to a specific binder resin to be dispersed therein.

The binder resin used for forming the surface layer has an SP value in the range from 7.5 to 9.0, preferably from 7.6 to 8.9. By using the binder resin of this kind, a change in the quantity of charge can be restrained even upon variation in the ambient environment. In the case when the SP value of the binder resin is greater than 9.0, the level of the quantity of charge in the toner becomes higher under the low moisture environment, resulting in degradation in the charging stability against environmental variations. When the SP value of the binder resin is smaller than 7.5, the charge level of the toner is lowered under the high moisture environment, resulting in degradation in the charging stability against environmental variations.

The binder resin is not particularly limited as long as the SP value is maintained in the above-mentioned range. Specific examples thereof include: silicone-based alkyd resin, acrylonitrile-butadiene rubber, polyethylene, isoprene rubber polypropylene, styrene-butadiene rubber, butadiene rubber and natural rubber. In particular, a silicone-based alkyd resin is preferably used. In the case when binder resins of two or more kinds are used, those resins having the SP value in the above-mentioned range are preferably used as all of the resins. Since the SP value is different depending on the kinds of resins, the SP value can be adjusted by forming a composite resin by graft-coupling or copolymerizing a plurality of resins.

The SP value, which is a parameter value for solubility, is a numeric value indicating size of aggregation energy of a substance.

Supposing that the evaporation energy and the mole volume of an atom or an atomic group are respectively represented by Δei and Δvi, the solubility parameter value σ is calculated by the following equation (1) in accordance with a method proposed by Fedors "Polym. Eng. Sci., vol 14, p 147 (1974)":

$$\sigma=(\Sigma\Delta ei/\Sigma\Delta vi)^{1/2} \quad \text{Equation (1)}$$

In the present specification, the solubility parameter value of the binder resin is calculated by a product between the solubility parameter value and the molar ratio of each of the components. For example, in the case when it is supposed that the binder resin is formed by two kinds of monomers X and Y, supposing that the mass compounding ratios of the respective monomers are x and y (mass %), that the molecular weights are Mx and My, and that the solubility parameter values are SPx and SPy, the respective monomer ratios are indicated by x/Mx and y/My. Here, supposing that mole ratio of the copolymer resin is C, the equation C=x/Mx+y/My is obtained, and the solubility parameter value SP of the binder resin is represented by the following equation (2):

$$SP=\{(x\times SPx/Mx)+(y\times SPy/My)\}\times 1/C \quad \text{Equation (2)}$$

Here, the solubility parameters SPx and Spy of the respective monomers are calculated by the above-mentioned equation (1), and with respect to the specific values, those values listed in a document such as "Polymer Handbook (published by John Wiley & Sons Inc.) $4^{th}$ Edition" may be utilized.

The molecular weight of the binder resin is not particularly limited, as long as the surface layer is allowed to have sufficient thermal stability, film strength and the like.

The roughness-imparting particles are made of a resin having an SP value that has a difference from the SP value of the binder resin of 2 or less, preferably 1 or less, in its absolute value. Since the roughness-imparting particles of this kind have a superior compatibility to the binder resin, they are easily dispersed in the binder resin, so that the roughness-imparting particles are prevented from being aggregated. Moreover, since the adhesion and adhesive property between the roughness-imparting particles and the binder resin are improved, the separation of the roughness-imparting particles can be restrained even when the developing roller is endurance-driven. Even when the surface layer is worn to cause the roughness-imparting particles to be exposed, the separation of the particles can be restrained. As a result, it is possible to achieve evenness of the image density, and also achieve sufficient charging property and transporting property of the toner in a stable manner. In the case when the absolute value of a difference between the SP values of the resin forming the roughness-imparting particles and the binder resin exceeds 2, since the roughness imparting particles are aggregated upon forming the surface layer, concave/convex irregularities occur on the surface resulting in unevenness in the image density. Moreover, the separation of the roughness-imparting particles occurs when the developing roller is endurance-driven, failing to provide sufficient toner charging property and transporting property.

With respect to the resin forming the roughness-imparting particles (hereinafter, referred to also as resin for particles), although not particularly limited as long as its SP value satisfies the above-mentioned relationship with the binder resin, those having an SP value from 7 to 11, in particular, from 7.5 to 10, are normally used. Specific examples of the resin for particles include: fluororubber, silicone rubber, polyethylene, butadiene-styrene rubber, polystyrene, acrylonitrile-butadiene rubber, vinylacetate resin, epoxy resin, PMMA resin, acrylic resin and polyester resin.

In the present specification, the SP value of the resin for particles (solubility parameter value) is calculated in the same manner as the SP value of the binder resin. In the above-mentioned explanation of the SP value of the binder resin, by substituting "resin for particles" for "binder resin", the same explanation can be applied to the explanation of the SP value of the resin for particles.

The preferable combinations between the binder resin and the resin for particles, used for forming the surface layer, are listed as follows:

(1) Binder resin: silicone-based alkyd resin/Resin for particles: fluororubber, (2) Binder resin: silicone-based alkyd resin/Resin for particles: PMMA resin, (3) Binder resin: acrylonitrile-butadiene rubber/Resin for particles: fluororubber, (4) Binder resin: acrylonitrile-butadiene rubber/Resin for particles: PMMA resin, (5) Binder resin: acrylonitrile-butadiene rubber/Resin for particles: epoxy resin.

The average particle size of the roughness-imparting particles is preferably set in the range from 10 to 50 μm, preferably from 20 to 30 μm, from the viewpoints of improvements for the toner transporting amount and prevention of irregularities.

The roughness-imparting particles are preferably made to have a spherical shape, and the average degree of roundness is set to 0.94 or more, in particular, to 0.97 or more. The average degree of roundness of less than 0.94 allows the particles to easily aggregate, resulting in concave/convex irregularities on the surface of the surface layer and the subsequent unevenness in the image density.

In the present specification, the average degree of roundness is a value obtained from the following processes: the degree of roundness, represented by the following equation, is measured with respect to a plurality of particles, and the total sum of degrees of roundness of all the particles thus measured is divided by the total number of the particles.

Degree of roundness=(Peripheral length of a circle having the same projection area as that of a particle image/Peripheral length of a particle projection image)

With respect to the values of the average particle size and the average degree of roundness, those values obtained by the following processes are used: the roughness-imparting particles are put into a dispersion solution, and after having been dispersed by an ultrasonic dispersing device, the resulting solution is introduced into a flow-type particle analyzer FPIA-2100 (made by Cismex Corporation), so that the average value of about 3000 particles is obtained.

The amount of addition of the roughness-imparting particles is preferably set in the range from 5 to 70 parts by weight, preferably from 8 to 50 parts by weight, with respect to 100 parts by weight of the binder resin.

The surface roughness (Ra) of the surface layer is set in the range from 0.8 to 3.0, preferably from 1.0 to 2.5 μm. In the present invention, since the separation of the roughness-imparting particles is restrained, such a surface roughness can be maintained for a long time. When Ra is too low, the amount of toner transportation is reduced, failing to provide sufficient image density. When Ra is too high, the amount of toner transportation becomes too high, resulting in reduction in the quantity of charge.

Normally, a conductive agent is added to the surface layer to be dispersed therein, so that a conductive property is imparted thereto.

With respect to the conductive agent to be added to the surface layer, the same conductive agent as that contained in the elastic layer may be used.

The content of the conductive agent in the surface layer is not particularly limited, and is normally set to an amount that provides a volume resistivity of the surface layer of $10^5$ Ω·cm or less, preferably $10^4$ Ω·cm or less.

Although an additive such as a conductive agent is contained in the surface layer, the influence of the conductive agent given to the relationship between the SP values of the binder resin and the roughness-imparting particles is very small. This is because the dispersed particle size of the conductive agent is extremely smaller than the particle size of the roughness-imparting particles.

The surface layer can be formed through the following processes: a coating solution, prepared by dissolving•dispersing a binder resin and roughness-imparting particles, as well as a conductive agent, if necessary, in an organic solvent, is applied and dried to be cured thereon.

With respect to the dispersing method, those methods which use a conventionally known dispersing device, such as a paint shaker mill, a sand mill, an attritor and a Dyno-mill, are preferably used.

With respect to the applying method, a conventionally known method, such as a spraying method, a dipping method, a roll coater method and a brush coating method, may be used.

The drying process is normally carried out by a heating treatment using a hot-air drying furnace.

The thickness of the surface layer is set in the range from 10 to 200 μm, preferably from 15 to 50 μm.

Some intermediate layers may be formed between the elastic layer and the surface layer.

The intermediate layers are formed for the purposes of improving the adhesive property between the base and the surface layer and of reducing resistance irregularities, or the like.

Figure 3:
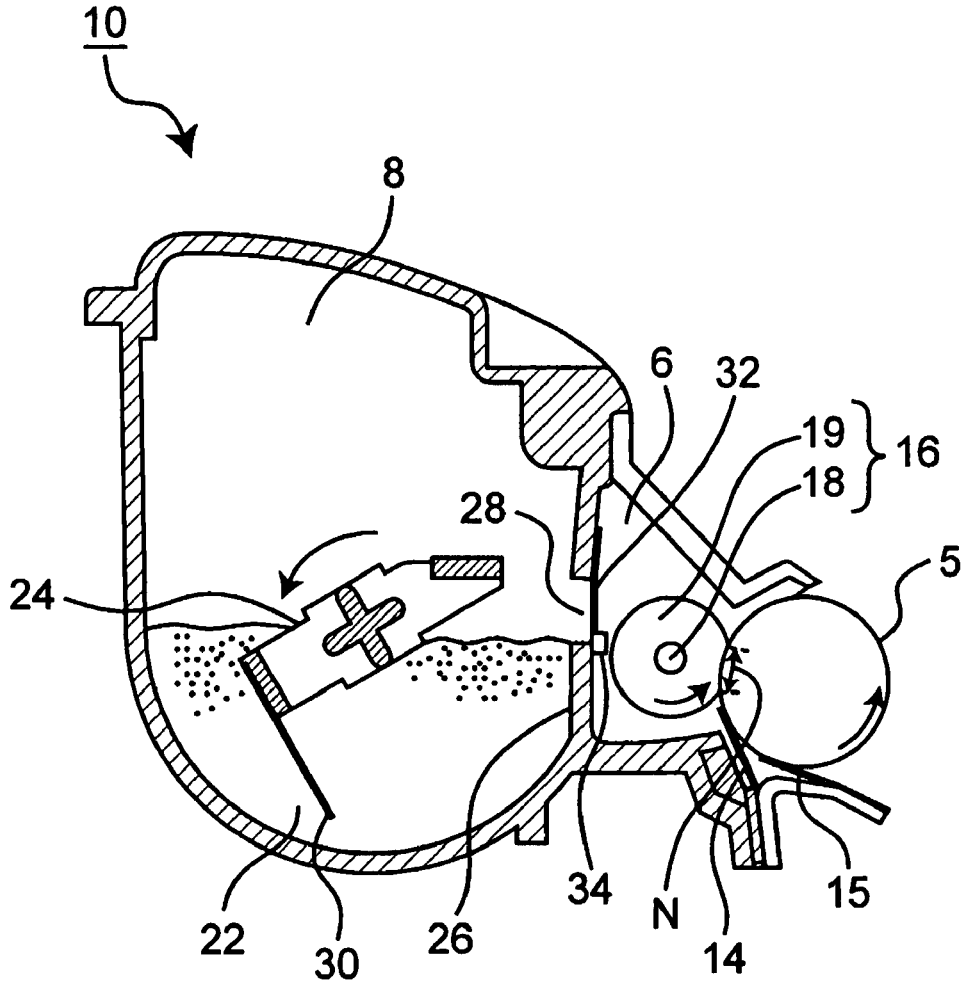
FIG. 3; a schematic drawing that shows one example of the developing device of the present invention.

A developing device in accordance with the present invention is provided with the above-mentioned developing roller, and, for example, a developing device as shown in FIG. 3 is exemplified. FIG. 3 shows one embodiment of the developing device relating to the present invention. The developing device, the entire structure of which is indicated by reference numeral 10, is provided with a developing roller 5 relating to the present invention, which is driven to rotate anticlockwise in the Figure by a motor not shown, assembled in an image-forming apparatus, and is made in contact with, or brought close to an image-supporting member not shown, a buffer chamber 6 placed on the left side of the developing roller 5 and a hopper 8 placed on the left side of the buffer chamber.

More specifically, in the buffer chamber 6, a blade 14, serving as a toner regulating member, is made in press-contact with the developing roller 5. The blade 14 is used for regulating the quantity of charge and the amount of adhesion of toner on the developing roller 5. Moreover, a blade 15, which assists the regulation of the quantity of charge and the amount of adhesion of the toner on the developing roller 5, may be placed on the downstream side of the blade 14 with respect to the rotation direction of the developing roller 5.

A supply roller 16 is pressed onto the developing roller 5 in the region N. The supply roller 16 is driven to rotate in the same direction (anticlockwise in the Figure) as the developing roller 5 by a motor not shown. The supply roller 16 is provided with a column-shaped conductive base member 18 and a foamed layer 19 that is made of urethane foam or the like, and formed on the outer circumference of the base member.

A toner 22 that is a mono-component developer is housed in the hopper 8. The hopper 8 is also provided with a rotation member 24 used for stirring the toner 22. A film-state transporting blade 30, which transports the toner 22 by the rotation of the rotation member 24 in an arrow direction, and supplies the toner 22 into the buffer chamber 6 through a passage 28 formed on a partition wall 26 that separates the hopper 8 and the buffer chamber 6, is attached to the rotation member 24. The transporting blade 30 is warped while transporting the toner 22 on the front side of the blade 30 in the rotation direction in accordance with the rotation of the rotation member 24, and is made to return to its straight state upon reaching the end portion on the left side of the passage 28. This returning force from the curved state makes it possible to supply the toner 22 on the blade 30 to the passage 28. A valve 32 is installed at the end portion on the right side of the passage 28 in a manner so as to close the passage 28. The valve 32, which is a film-state member, has its one end secured onto the upper side on the right side face of the passage 28 of the partition wall 26, and when the toner 22 is supplied to the passage 28 from the hopper 8, it is pressed to the right side by the pressing force from the toner 22, so that the passage 28 is opened. As a result, the toner 22 is supplied to the buffer chamber 6 and housed therein. A regulating member 34 is attached to the other end of the valve 32. Between the regulating member 34 and the supply roller 16, a slight gap is prepared, with the passage 28 being closed by the valve 32. Since an excessively large amount of toner accumulated on the bottom of the buffer chamber 6 might cause toner aggregation, the regulating member 34 is used for preventing a large amount of toner, recovered from the developing roller 5 to the supply roller 16, from falling down onto the bottom of the buffer chamber 6.

In this developing device 10, upon forming an image, the developing roller 5 is driven to rotate in an arrow direction, while the toner in the buffer chamber 6 is being supplied onto the developing roller 5 by the rotation of the supply roller 16. Successively, the toner is electrically charged and formed into a thin-film state by the blades 14 and 15, and is then transported to an opposing area to the image-supporting member so as to be used for developing an electrostatic latent image on the image-supporting member. The toner, which has not been used in the developing process, is returned to the buffer chamber 6 in accordance with the rotation of the developing roller 5, and scraped from the developing roller 5 and recovered by the supply roller 16.

An image-forming apparatus relating to the present invention, which has a developing device having the above-mentioned developing roller, is normally provided with at least an image-supporting member (photosensitive member), a charging device that evenly charges the surface of the image-supporting member, an exposing device that forms an electrostatic latent image on the surface of the image-supporting member, a developing device that allows the developing roller to transport toner, and develops the electrostatic latent image, and a transferring device that transfers the developed toner image onto a medium.

EXAMPLES

The following description will discuss Examples of the present invention in more detail. Here, in the following description, the term "parts" refer(s) to "part(s) by weight".

<Binder Resin of Surface Layer>

Binder resins listed on Table 1 were used as binder resins for the surface layer. Table 1 also shows their SP values.

TABLE 1

| Binder resin | | SP value |
|---|---|---|
| A-1 | Silicone resin | 7.3 |
| A-2 | Silicone-based alkyd resin | 7.6 |
| A-3 | NBR | 8.9 |
| A-4 | Urethane rubber | 10.0 |

A-1: Silicone resin made by Shin-Etsu Chemical Co., Ltd. was used.
A-2: Silicone-based alkyd resin made by Dow Corning Toray Silicone Company, LTD. was used.
A-3: NBR made by Zeon Corporation was used.
A-4: Urethane rubber made by Sakai Chemical Industrial Co., Ltd. was used.

<Roughness-Imparting Particles of Surface Layer>

Roughness-imparting particles, listed in Table 2, were used as roughness-imparting particles for the surface layer. Table 2 also shows the SP value, average particle size and average degree of roundness thereof.

TABLE 2

| Roughness-imparting particles | | SP value | Average particle size (μm) | Average degree of roundness |
|---|---|---|---|---|
| B-1 | Fluororubber | 7.3 | 20 | 0.99 |
| B-2 | PMMA resin | 9.4 | 20 | 0.97 |
| B-3 | Epoxy resin | 10.9 | 20 | 0.96 |
| B-4 | Phenol resin | 11.3 | 20 | 0.97 |
| B-5 | PMMA resin | 9.4 | 30 | 0.94 |
| B-6 | Epoxy resin | 10.9 | 20 | 0.94 |

B-1: Fluororubber particles made by JSR Corporation were used.
B-2: PMMA resin particles, MR-20G (made by Soken Chemical & Engineering Co., Ltd.), were used.
B-3: Epoxy resin particles, Polymerpole 20E (made by Sanyo Chemical Industries, Ltd.), were used.
B-4: Phenol resin particles, Marilyn (made by Gun Ei Chemical Industry Co., Ltd.), were used.
B-5: PMMA resin particles, MR-30G (made by Soken Chemical & Engineering Co., Ltd.), were used.
B-6: Epoxy resin particles, Polymerpole 20E (made by Sanyo Chemical Industries, Ltd.), were used.

Upon using Polymerpole 20E as roughness-imparting particles B-3 and B-6, deviations in the degree of roundness caused upon production were utilized, and those having an average degree of roundness of 0.96 were used for B-3, and those having an average degree of roundness of 0.94 were used for B-6.

Production of Developing Roller

Example 1

A metal mold in which a core metal serving as a shaft member (15 mm in diameter, made of SUS304) was set was filled with a conductive silicone rubber (X34-264A/B, made by Shin-Etsu Chemical Co., Ltd.) as a material for an elastic layer, and this was then subjected to a crosslinking process by applying heat under predetermined conditions (190° C.×15 minutes). This was then removed from the mold so that a base roller in which an elastic layer was formed along the outer circumferential face of the shaft member was manufactured. Next, after a coating solution for forming a surface layer was applied to the outer circumferential face of the elastic layer, this was cured by applying heat in an oven under conditions of 170° C.×1 hour, so that a surface layer was formed. In this manner, a developing roller having a two-layer structure in which the elastic layer was formed on the outer circumferential face of the shaft member, with the surface layer being formed on the outer circumferential face thereof, was manufactured.

The thickness of the elastic layer was 0.5 mm, and the thickness of the surface layer was 15 μm.

The coating solution used for forming the surface layer was prepared by stirring the following materials by using a sand mill.

| | |
|---|---|
| Binder resin A-2 (silicone-based alkyd resin: SP value 7.6) | 100 parts |
| Roughness-imparting particles B-1 (fluororubber particles: particle size 20 μm) | 20 parts |
| Conductive carbon black | 10 parts |
| Toluene | 400 parts |

More specifically, a silicone-based alkyd resin solution was diluted by one portion of toluene, and to this were added conductive carbon black and fluororubber particles, and the resulting solution was dispersed by using a sand mill with glass beads having a diameter of 1 mm being used as media. To this was further added the rest of the silicone-alkyd resin solution and toluene to prepare a coating solution.

Examples 2 to 11 and Comparative Examples 1 to 5

A developing roller was manufactured by using the same method as Example 1, except that binder resins and roughness-imparting particles listed in Table 3 were used and that the amount of addition of the roughness-imparting particles was changed to each of the amounts listed in Table 3. Here, the amount of addition of the particles in this Table refers to the amount of addition of the roughness-imparting particles with respect to 100 parts of the binder resin.

<Evaluation>

Each of the developing rollers was assembled into a developing device, and evaluated. Upon evaluation, a color printer Magicolor 2430 DL, made by Konica Minolta Holdings, Inc., was used.

(Dispersing Property)

The surface of the developing roller (initial state) prior to an endurance test was observed by a laser microscope (VK-9500: made by Shimadzu Corporation) at magnification of 400 times, so that "aggregation" of the roughness-imparting particles was evaluated.

○: No aggregation was observed.

x: Aggregation was observed.

(Separation Resistant Property)

Endurance printing processes of 4000 sheets were carried out on white paper under N/N environment (23° C., 65% RH).

The surface of the developing roller (after endurance) after the endurance test was observed by the laser microscope (VK-9500: made by Shimadzu Corporation) at magnification of 400 times, so that "separation" of the roughness-imparting particles was evaluated.

○: No separation was observed.

x: Separation was observed.

(Surface Roughness)

The surface roughness (Ra) of the developing roller before and after the endurance test was measured by using a surface-roughness measuring device SURFCOM480A (made by Accretech). The measurements were carried out on three points in the axial direction as well as on three points in the circumferential direction, that is, six points all together, and the average value was found. The measuring conditions were: 0.3 mm/s in feeding speed; 2.5 mm in measuring length; and 0.8 mm in roughness cutoff.

(Charging Stability Under Environmental Variations)

Image-forming processes were carried out by applying a predetermined developing bias under low-temperature/low-humidity (LL) environment (10° C., 15% RH), as well as under high-temperature/high-humidity (HH) environment (35° C., 85% RH). Each of the developing devices was exposed to each of the environments at least for 24 hours or more so as to allow it to adapt to the environment, and this was then subjected to the image-forming processes. In the middle of the image-forming processes, the operation was stopped, and the quantity of charge (Q) and the amount of transportation (M) of the toner on the developing roller were measured, and Q/M (pC/g) was calculated. With respect to the quantity of charge under LL environment (Q/M (LL)), the range that causes no problems in practical use is 30 μC/g or less. The quantity exceeding 30 μC/g causes reduction in the amount of toner capable of developing, resulting in insufficient image density. With respect to the quantity of charge under HH environment (Q/M (HH)), the range that causes no problems in practical use is 15 μC/g or more. The quantity of less than 15 μC/g causes reduction in the adhesive force to the developing roller, resulting in image noise, such as base fogging, and contamination and the like inside the machine due to increased toner scattering. A difference in the quantity of charge between LL environment and HH environment is preferably made as small as possible. With respect to the difference in the quantity of charge, the range that causes no problems in practical use is less than 12 μC/g, preferably less than 11 μC/g.

The quantity of charge was measured by the following method.

Each of the developing devices was exposed to each of LL environment (15° C., 10% RH) and HH environment (35° C., 80% RH) for one day so as to allow it to adapt to the environment, and this was then used for printing one sheet in white paper mode; thus, the quantity of charge was measured on the toner on the developing roller by using a suction method.

The amount of transportation was measured by the following method.

The amount of transportation of the toner was measured by using a toner suction method on the developing roller. The amount of the toner thus sucked was divided by the area of the suction process.

What is claimed is:

1. A developing roller, having a surface layer comprising;

a binder resin having a solubility parameter (SP) value in the range of 7.5 to 9.0; and roughness-imparting particles made of a resin having an SP value that has a difference from the SP value of said binder resin of no more than 2 or less in the absolute value thereof, the roughness-imparting particles being dispersed in the binder resin.

2. The developing roller according to claim 1, wherein the roughness-imparting particles have an average degree of roundness of 0.94 or more.

3. The developing roller according to claim 1, wherein the roughness-imparting particles have an SP value in the range of 7 to 11.

4. The developing roller according to claim 1, wherein the roughness-imparting particles have an average particle size in the range from 10 to 50 μm.

5. The developing roller according to claim 1, wherein the surface layer has a surface roughness (Ra) in the range from 0.8 to 3.0 μm.

6. The developing roller according to claim 1, wherein the binder resin has an SP value in the range of 8.0 to 9.0.

7. The developing roller according to claim 1, wherein the roughness-imparting particles have an average degree of roundness of 0.97 or more.

8. A developing device provided with a developing roller, wherein the developing roller has a surface layer comprising;

a binder resin having a solubility parameter (SP) value in the range of 7.5 to 9.0; and roughness-imparting particles made of a resin having an SP value that has a difference from the SP value of said binder resin of no more than 2 or less in the absolute value thereof, the roughness-imparting particles being dispersed in the binder resin.

9. The developing device according to claim 8, wherein the roughness-imparting particles have an average degree of roundness of 0.94 or more.

TABLE 3

| | Binder resin | Resin particle | \|ΔSP\| | Amount of addition | Initial Ra | Dispersing property (Initial observation) | Endurance Ra | Separation resistant property (Endurance observation) | Q/M(LL) | Q/M(HH) |
|---|---|---|---|---|---|---|---|---|---|---|
| Example 1 | A-2 | B-1 | 0.3 | 20 | 2.1 | ○ | 2.0 | ○ | 25.6 | 15.6 |
| Example 2 | A-2 | B-2 | 1.8 | 20 | 2.0 | ○ | 1.8 | ○ | 27.4 | 17.4 |
| Example 3 | A-3 | B-1 | 1.6 | 20 | 2.3 | ○ | 2.1 | ○ | 26.3 | 15.4 |
| Example 4 | A-3 | B-2 | 0.5 | 20 | 2.1 | ○ | 2.0 | ○ | 26.6 | 17.3 |
| Example 5 | A-3 | B-3 | 2 | 20 | 1.9 | ○ | 1.8 | ○ | 28.5 | 18.9 |
| Example 6 | A-2 | B-5 | 1.8 | 6.5 | 2.5 | ○ | 2.4 | ○ | 25.3 | 15.6 |
| Example 7 | A-3 | B-6 | 2 | 20 | 1.8 | ○ | 1.7 | ○ | 27.5 | 18.3 |
| Comparative Example 1 | A-1 | B-1 | 0 | 20 | 1.9 | ○ | 1.8 | ○ | 23.7 | 9.2 |
| Comparative Example 2 | A-1 | B-2 | 2.1 | 20 | 2.0 | ○ | 0.6 | X | 24.2 | 8.3 |
| Comparative Example 3 | A-2 | B-3 | 3.3 | 20 | 2.5 | X | 0.5 | X | 22.4 | 13.7 |
| Comparative Example 4 | A-3 | B-4 | 2.4 | 20 | 2.3 | ○ | 0.6 | X | 25.8 | 14.2 |
| Comparative Example 8 | A-4 | B-1 | 2.7 | 20 | 2.6 | X | 0.4 | X | 30.1 | 18.3 |
| Comparative Example 10 | A-4 | B-3 | 0.9 | 20 | 2.2 | ○ | 1.9 | ○ | 33.4 | 16.9 |

10. The developing device according to claim 8, wherein the roughness-imparting particles have an SP value in the range of 7 to 11.

11. The developing device according to claim 8, wherein the roughness-imparting particles have an average particle size in the range from 10 to 50 μm.

12. The developing device according to claim 8, wherein the surface layer has a surface roughness (Ra) in the range from 0.8 to 3.0 μm.

13. The developing device according to claim 8, wherein the roughness-imparting particles have an average degree of roundness of 0.97 or more.

14. An image-forming apparatus provided with a developing device, equipped with a developing roller, wherein the developing roller has a surface layer comprising;

a binder resin having a solubility parameter (SP) value in the range of 7.5 to 9.0; and roughness-imparting particles made of a resin having an SP value that has a difference from the SP value of said binder resin of no more than 2 or less in the absolute value thereof, the roughness-imparting particles being dispersed in the binder resin.

15. The image-forming apparatus according to claim 14, wherein the roughness-imparting particles have an average degree of roundness of 0.94 or more.

16. The image-forming apparatus according to claim 14, wherein the roughness-imparting particles have an SP value in the range of 7 to 11.

17. The image-forming apparatus according to claim 14, wherein the roughness-imparting particles have an average particle size in the range from 10 to 50 μm.

18. The image-forming apparatus according to claim 14, wherein the surface layer has a surface roughness (Ra) in the range from 0.8 to 3.0 μm.

19. The image-forming apparatus according to claim 14, wherein the roughness-imparting particles have an average degree of roundness of 0.97 or more.

* * * * *